US009067663B2

(12) United States Patent
Byun et al.

(10) Patent No.: US 9,067,663 B2
(45) Date of Patent: Jun. 30, 2015

(54) FLOATING STRUCTURE HAVING AN UPPER DECK FUEL TANK

(75) Inventors: Yoon Chul Byun, Gyeongsangnam-do (KR); Dong Kwon Lee, Gyeonggi-do (KR); Cheon Hwan Yeom, Gyeonggi-do (KR); Hyung Kyun Seo, Gyeongsangnam-do (KR); Young Man Lee, Gyeonggi-do (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 176 days.

(21) Appl. No.: 13/698,602

(22) PCT Filed: Oct. 5, 2010

(86) PCT No.: PCT/KR2010/006790

§ 371 (c)(1),
(2), (4) Date: Feb. 13, 2013

(87) PCT Pub. No.: WO2011/145784

PCT Pub. Date: Nov. 24, 2011

(65) Prior Publication Data

US 2013/0137318 A1 May 30, 2013

(30) Foreign Application Priority Data

May 19, 2010 (KR) ..... 10-2010-0046787

(51) Int. Cl.
*B63B 25/16* (2006.01)
*B63H 21/38* (2006.01)

(52) U.S. Cl.
CPC ..... *B63H 21/38* (2013.01); *B63B 25/16* (2013.01)

(58) Field of Classification Search
USPC ..... 114/74 A
IPC ..... B63B 25/16
See application file for complete search history.

(56) References Cited

U.S. PATENT DOCUMENTS

| | | | | | |
|---|---|---|---|---|---|
| 1,140,250 | A | * | 5/1915 | Cabot | 137/335 |
| 3,422,779 | A | * | 1/1969 | Becker | 114/74 A |
| 3,968,764 | A | * | 7/1976 | Kvamsdal et al. | 114/74 A |
| 4,004,535 | A | * | 1/1977 | Oiern et al. | 114/74 A |
| 4,106,424 | A | * | 8/1978 | Schuler et al. | 114/74 A |
| 2006/0156744 | A1 | * | 7/2006 | Cusiter et al. | 62/50.2 |
| 2009/0239426 | A1 | | 9/2009 | Levander et al. | |

FOREIGN PATENT DOCUMENTS

| | | | |
|---|---|---|---|
| JP | 55-95995 | U | 7/1980 |
| JP | 60-148195 | U | 10/1985 |
| JP | 61-241293 | | 10/1986 |
| JP | 09-133297 | | 5/1997 |
| JP | 3130979 | U9 | 3/2007 |
| JP | 2008-126829 | | 6/2008 |
| JP | 2010-023776 | | 2/2010 |
| KR | 10-0305513 | B1 | 11/2001 |
| KR | 10-2009-0021179 | A | 2/2009 |
| KR | 10-2009-0098387 | A | 9/2009 |
| KR | 10-0961868 | B1 | 6/2010 |
| KR | 20-2011-0004798 | U | 5/2011 |

* cited by examiner

*Primary Examiner* — Stephen Avila
(74) *Attorney, Agent, or Firm* — Seed IP Law Group PLLC

(57) ABSTRACT

A floating structure with an on-deck fuel tank that is surrounded by a cover is provided. In the floating structure, since the fuel tank is covered by the cover, the fuel tank is sealed without being exposed to air, thereby enhancing safety. The fuel tank is configured to store liquefied fuel gas to be used as fuel. The fuel tank is installed on a deck of the floating structure, and the exterior of the fuel tank is surrounded by a cover.

9 Claims, 1 Drawing Sheet

FLOATING STRUCTURE HAVING AN UPPER DECK FUEL TANK

CROSS-REFERENCE TO RELATED APPLICATION

This application is a national stage application filed under 35 U.S.C. §371 of International Application No. PCT/KR2010/006790, accorded an International Filing Date of Oct. 5, 2010, which claims priority to Korean Patent Application No. 10-2010-0046787, filed on May 19, 2010 in the Korean Intellectual Property Office, which is hereby incorporated by reference in its entirety.

BACKGROUND

1. Technical Field

The present disclosure relates to a floating structure with an on-deck fuel tank, and more particularly, to a floating structure with an on-deck fuel tank which is covered to seal the fuel tank so that the fuel tank is not exposed to air, thereby enhancing safety.

2. Description of the Related Art

Recently, in order to solve environmental problems such as global warming, environmental pollution, and the like, regulations for carbon emission are being actively discussed all over the world. Also, environment-friendly logistics such as low-carbon green growth have been proposed in Korea.

In shipbuilding fields, a large amount of carbon dioxide is emitted by the use of existing fossil fuel. Therefore, many efforts have been made to reduce carbon dioxide emission.

Generally, various ships such as bulk carriers, container ships, crude oil carriers, passenger ships, and the like have employed a fuel supply system using heavy oil (HFO) or diesel oil (MDO), for example, bunker C oil, which is liquid fuel, as propulsion fuel.

In the conventional fuel supply system, if heavy oil or the like used as fuel is combusted, serious environmental pollution is caused due to various harmful substances contained in the exhaust gas. As the prevention of environmental pollution is increasingly demanded worldwide, regulations for propulsion systems using heavy oil as fuel oil have been reinforced. As a result, costs for meeting these regulations have been gradually increased.

Also, if oil prices are considerably increased by factors such as depletion of fossil fuel, localized unrest, or the like, several operational problems such as the rapid increase of fuel expenses of ships using heavy oil as fuel, etc., will be caused.

Thus, technologies for using liquefied fuel gas that is environment-friendly fuel as fuel of ships have recently attracted attention. The term "liquefied fuel gas" as used herein represents gaseous fuel, such as LNG, LPG, CNG, DME, or the like. The liquefied fuel gas exists in a liquid or gas state when being stored in a fuel tank, but exists in a gas state when being fed to a propulsion system.

Liquefied Natural Gas (LNG) is generated by liquefying natural gas collected from a gas field. The main component of LNG is methane. LNG is advantageous in terms of space efficiency because its volume is reduced to about 1/600 when being liquefied by lowering its temperature or applying a pressure. However, since LNG has a low boiling point of about −162° C., LNG needs to be loaded into a specially insulated tank or container and be kept below a boiling point during transportation and storage.

Liquefied Petroleum Gas (LPG) is generated by cooling and liquefying heavy hydrocarbon (two or more carbon atoms) component generated at the time of collecting crude oil from an oil field or purifying crude oil or heavy hydrocarbon component collected together at the time of collecting natural gas at a relatively low pressure (about 6 kg/cm$^2$ to about 7 kg/cm$^2$). LPG is advantageous in terms of storage and transportation because the volume thereof is reduced to about 1/250 during liquefaction. The main component of LPG is propane and butane, and LPG may contain a small amount of ethane, propylene, butylen, or the like.

Compressed Natural Gas (CNC) is generated by compressing natural gas at about 20 MPa so as to use the natural gas as fuel.

Dimethyl Ether (DME) is a kind of ether and has lower flammability and less toxicity than LPG. Also, DME has a small environmental load because a small amount of exhaust fume is generated during the combustion due to high oxygen concentration.

When LNG is used as fuel of ships among the above-described liquefied fuel gases, carbon dioxide emission of LNG is about 20% smaller than that of petroleum-based fuels such as diesel oil, bunker C oil, or the like. Furthermore, since nitrogen oxide and sulfur oxide, which are the main cause of air pollution, are not almost exhausted, LNG can be used as an environmental-friendly fuel.

In case of LNG carriers, much discussion has been made about technologies for duel fuel engines using boil-off gas (BOG). Also, much discussion has been made about technologies that utilize liquefied fuel gas, including LNG, as propulsion fuel for ships. However, these technologies are still in the early stage of development.

In general, since liquefied fuel gas such as LNG is lower in density than liquid fuel such as HFO, a fuel tank is inevitably increased in volume as compared with the case where only liquid fuel having relatively high density is used as fuel. Thus, in the case where a fuel tank for liquefied fuel gas is installed in a ship, a space for accumulating cargo may be reduced as compared with the case where a fuel tank for liquid fuel such as HFO is installed.

To solve this problem, when the consumption of fuel is small, detachable fuel tanks may be used such that some of plural fuel tanks are removable, or a fuel tank may be installed on a deck of a floating structure.

BRIEF SUMMARY

An aspect of the present invention is directed to provide a floating structure in which a fuel tank for storing liquefied fuel gas can be mounted on a deck to minimize the reduction of cargo accumulation space, and the fuel tank mounted on the deck can be covered by a cover to seal the fuel tank so that fuel tank is not exposed to air, thereby enhancing safety.

According to an embodiment of the present invention, a floating structure includes a fuel tank configured to store liquefied fuel gas to be used as fuel, wherein the fuel tank is installed on a deck of the floating structure, and the exterior of the fuel tank is surrounded by a cover.

The fuel tank may be supported on the deck by a support member.

The support member may be disposed between the fuel tank and the cover, and may include a tank support configured to support the fuel tank and a cover support configured to support the cover.

The tank support and the cover support may have the same central axis line.

The tank support and the cover support may be provided in plurality, and central axis lines of at least one tank support and cover support may be disposed on a central axis line of a width direction of the fuel tank.

A rolling key configured to absorb vibration generated in a width direction of the fuel tank and a pitching key configured to absorb vibration generated in a length direction of the fuel tank may be disposed between the fuel tank and the cover.

The fuel tank may include an IMO type B tank among independent tanks

Inert gas, including nitrogen, may be filled within a space between the fuel tank and the cover.

A sensor configured to detect leakage of the liquefied fuel gas from the fuel tank may be disposed in the space between the fuel tank and the cover.

The fuel tank may be provided in plurality, and the fuel tank near a bow of the floating structure among the plurality of fuel tanks may be lower than the fuel tank near a stern of the floating structure.

DETAILED DESCRIPTION

Hereinafter, a floating structure with an on-deck fuel tank according to an exemplary embodiment of the present invention will be described in detail with reference to the accompanying drawings.

Figure 1:
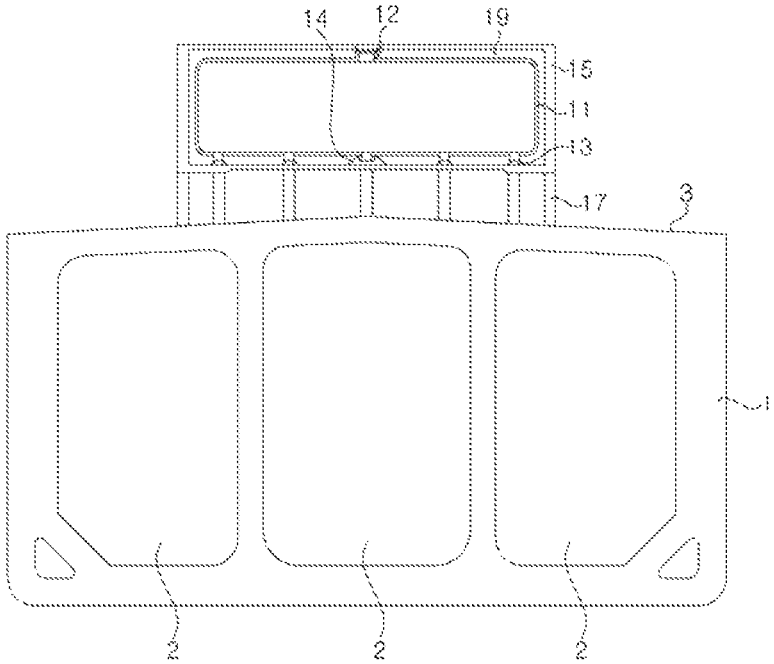
FIG. 1 is a cross-sectional view of a floating structure with an on-deck fuel tank.

FIG. 1 is a cross-sectional view of a floating structure with an on-deck fuel tank.

The term "floating structure" as used herein implies a variety of ships, including a bulk carrier, a container ship, a crude oil carrier, and a passenger ship, and a marine plant, including an oil-floating production storage offloading (oil-FPSO), a liquefied natural gas-floating production storage offloading (LNG FPSO), a liquefied natural gas-floating storage and regasification unit (LNG FSRU), and a floating production unit (FPU), which are mooring at a spot of sea at normal times.

As shown in FIG. 1, a fuel tank 11 may be installed on a deck 3 of the floating structure. Also, the fuel tank 11 may be surrounded by a cover 15, so that the fuel tank 11 is not exposed to air. The cover 15 may be a structure capable of covering all surfaces, that is, top, bottom, left, and right surfaces of the fuel tank 11. A sealed space 19 may be defined between the cover 15 and the fuel tank 11. Thus, the fuel tank 11 is not directly exposed to air. As a result, the fuel tank 11 installed on the deck 3 of a hull 1 may be safely protected.

The cover 15 may be made of metal, plastic, or the like. Preferably, the cover 15 may be made of the same material as the hull 1.

The fuel tank 11 includes an appropriate insulation/sealing system according to a type of fuel to be stored. In particular, examples of the fuel tank for storing liquefied gas such as LNG and LPG may include membrane type tanks or independent tanks, which have been used in liquefied gas storage fields. In an exemplary embodiment of the present invention, an IMO type B tank among the independent tanks will be used.

A storage tank 2 for storing and transporting cargo may be installed within the hull 1.

The fuel tank 11 may be supported on the deck 3 by support members. More specifically, the fuel tank 11 may be supported by a tank support 13 disposed between the fuel tank 11 and the cover 15. Also, the cover 15 surrounding the fuel tank 11 may be supported by a cover support 17 disposed between the cover 15 and the deck 3. Due to the cover support 17, the fuel tank 11 may be mounted on the deck 3 while avoiding interference with a plurality of pipes and a variety of equipment, which are disposed on the deck 3.

When the tank support 13 and the cover support 17 have the same central axis line, the support members may more firmly support the fuel tank 11, but embodiments of the present invention are not limited thereto. For example, the cover support 17 and the tank support 13 may have different central axis lines according to the weight of the fuel tank 11, a method of installing the fuel tank 11 on the deck 3, and the like.

In addition to the tank support 13, an upper rolling key 12, a lower rolling key 14, and a pitching key (not shown), which are capable of absorbing vibration transferring to the fuel tank 11, may be disposed between the fuel tank 11 and the cover 15. The upper rolling key 12 and the lower rolling key 14 may absorb vibration generated in a width direction of the fuel tank 11, and the pitching key (not shown) may absorb vibration generated in a length direction of the fuel tank 11.

Although the upper rolling key 12 and the lower rolling key 14 are illustrated as being installed between the fuel tank 11 and the cover 15 at middle positions in the width direction of the fuel tank 11, embodiments of the present invention are not limited to the installation positions of the upper and lower rolling keys 12 and 14. Thus, the upper and lower rolling keys 12 and 14 may be installed at adequate positions according to different situations.

Inert gas, such as nitrogen, may be filled within the sealed space 19 between the fuel tank 11 and the cover 15. Even though liquefied fuel gas leaks from the fuel tank 11 in a state of emergency, the cover 15 prevents the liquefied fuel gas from leaking to the outside of the cover 15. Even if the liquefied fuel gas leaks, it may prevent the liquefied fuel gas from exploding by the inert gas filled between the fuel tank 11 and the cover 15.

Although not shown, a sensor for detecting the leakage of the liquefied fuel gas may be installed in the sealed space 19. The installation of the sensor makes it possible to detect where the liquefied fuel gas leaks in the fuel tank 11. Therefore, a proper action can be promptly taken.

Figure 2:
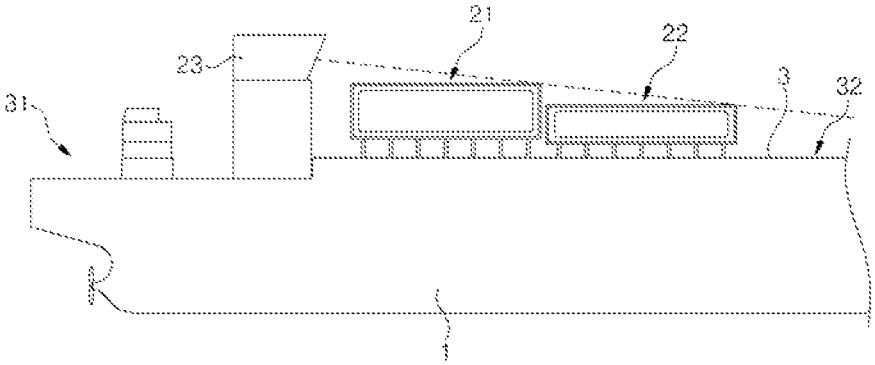
FIG. 2 is a view of a state in which a plurality of fuel tanks are mounted on a deck.

FIG. 2 illustrates a state in which a plurality of fuel tanks according to an exemplary embodiment of the present invention are mounted on a deck.

As shown in FIG. 2, when a plurality of fuel tanks are mounted on the deck 3 of the hull 1, a first fuel tank 21 disposed near a stern 31 may be mounted at a higher position than a second fuel tank 22 disposed near a bow 32. Therefore, the first fuel tank 21 may have larger storage capacity by a height difference between the first fuel tank 21 and the second fuel tank 22. Since the first and second fuel tanks 21 and 22 have the same structure as the above-described fuel tank, their detailed description will be omitted.

In a control room 23, it is necessary to secure a clear view so as to navigate the floating structure. Therefore, the fuel tanks have to be mounted on the deck 3 within a range in which the field of vision is not obstructed. Thus, a portion under dotted lines in FIG. 2 may be a space in which the fuel tanks can be mounted. As compared with the case where the first fuel tank 21 and the second fuel tank 22 are mounted at the same height, storage space of the fuel tank can be maximally increased when the first fuel tank 21 is mounted under dotted lines so as not to obstruct the field of vision in the control room 23 as shown in FIG. 2.

Although two fuel tanks are taken as an example in the exemplary embodiment of the present invention, the present invention is not limited thereto. For example, even though three or more fuel tanks are mounted on the deck, the fuel tanks may be provided with higher height toward the stern. In this manner, it is possible to efficiently utilize the storage space within a range in which the field of vision in the control room 23 is clearly secured.

As described above, according to the embodiments of the present invention, since the fuel tank 11 is surrounded by the cover 15, it may prevent the fuel tank 11 from coming into contact with air directly. Therefore, safety may be enhanced during transport.

Also, according to embodiments of the present invention, since the fuel tanks are mounted on the deck at different heights, a larger amount of fuel may be stored in the fuel tanks within a limited space on the deck without obstructing the field of vision.

As described above, embodiments of the present invention are directed to provide a floating structure in which the fuel tank for storing the liquefied fuel gas is mounted on the deck and is covered by the cover. Therefore, the fuel tank is sealed without being exposed to air, thereby enhancing safety.

Moreover, according to embodiments of the present invention, inert gas may be filled within the sealed space between the fuel tank and the cover to prevent the fuel tank from exploding even when the liquefied fuel gas leaks from the fuel tank in a state of emergency.

As described above, although exemplary embodiments of the floating structure with the on-deck fuel tank according to the present invention are described with reference to the accompanying drawings, the present invention is not limited to the above exemplary embodiments and drawings and thus, may be variously modified and changed by those skilled in the art to which the present invention pertains.

What is claimed is:

1. A floating structure comprising:

a deck of the floating structure;

a fuel tank located above the deck of the floating structure, the fuel tank configured to store liquefied fuel gas to be used as fuel for the floating structure;

a cover surrounding an exterior of the fuel tank;

at least one cover support disposed between the deck and the cover to support the cover above the deck; and at least one tank support disposed between the cover and the fuel tank to support the fuel tank.

2. The floating structure according to claim 1, wherein the tank support and the cover support have the same central axis line.

3. The floating structure according to claim 2, wherein the tank support and the cover support are provided in plurality, and central axis lines of at least one tank support and cover support are disposed on a central axis line of a width direction of the fuel tank.

4. A floating structure comprising:

a deck of the floating structure;

a fuel tank installed on the deck of the floating structure, the fuel tank configured to store liquefied fuel gas to be used as fuel for the floating structure;

a cover surrounding an exterior of the fuel tank;

a rolling key configured to absorb vibration generated in a width direction of the fuel tank disposed between the fuel tank and the cover; and a pitching key configured to absorb vibration generated in a length direction of the fuel tank disposed between the fuel tank and the cover.

5. The floating structure according to claim 1, wherein the fuel tank comprises an IMO type B tank among independent tanks.

6. The floating structure according to claim 1, wherein inert gas, including nitrogen, is filled within a space between the fuel tank and the cover.

7. The floating structure according to claim 6, further comprising:

a sensor configured to detect leakage of the liquefied fuel gas from the fuel tank disposed in the space between the fuel tank and the cover.

8. The floating structure according to claim 1, further comprising:

at least one supplemental fuel tank, the fuel tank positioned toward a bow of the floating structure and the supplemental fuel tank positioned toward a stern of the floating structure, and the fuel tank near the bow of the floating structure being lower than the supplemental fuel tank near the stern of the floating structure.

9. The floating structure according to claim 1, wherein an entirety of the fuel tank and an entirety of the cover surrounding the exterior of the fuel tank are supported above an upper surface of the deck.

* * * * *